United States Patent [19]

Kuehn

[11] Patent Number: 4,818,149

[45] Date of Patent: Apr. 4, 1989

[54] METHOD OF AND A DRIVE UNIT FOR DRIVING RAMMING PARTS UNDER WATER

[75] Inventor: Hans Kuehn, Hamburg, Fed. Rep. of Germany

[73] Assignee: Bomag-Menck GmbH, Boppard, Fed. Rep. of Germany

[21] Appl. No.: 133,901

[22] Filed: Dec. 15, 1987

[30] Foreign Application Priority Data

Jul. 28, 1987 [EP] European Pat. Off. ..... 87110889.0

[51] Int. Cl.[4] ..... E02D 7/06

[52] U.S. Cl. ..... 405/228; 405/232; 173/DIG. 1; 173/1

[58] Field of Search ..... 173/1, DIG. 1; 405/224, 405/225, 227, 228, 231, 232

[56] References Cited

U.S. PATENT DOCUMENTS

| | | | |
|---|---|---|---|
| 2,959,016 | 11/1960 | Parks | 405/228 |
| 3,502,159 | 3/1970 | Pogohowski | 405/228 X |
| 3,998,064 | 12/1976 | Jansz | 405/228 |
| 4,051,685 | 10/1977 | Jansz | 405/228 |

FOREIGN PATENT DOCUMENTS

| | | | |
|---|---|---|---|
| 0613008 | 6/1978 | U.S.S.R. | 405/232 |

*Primary Examiner*—Frank T. Yost
*Assistant Examiner*—James L. Wolfe
*Attorney, Agent, or Firm*—Michael J. Striker

[57] ABSTRACT

For driving of ramming parts under water, a first ramming device is suspended on the supporting element and a second ramming device is suspended on a further supporting element, a submergible electrohydraulic drive unit is located laterally near or under one of the ramming device and connected with both ramming devices by hose conduits, the ramming devices with the drive unit are lowered so that at least one ramming device is placed on one ramming part and after driving it in over a predetermined path it is transferred to another ramming part, while the other ramming device drives further the first ramming part or a further ramming part, and both ramming devices are driven one after the other or simultaneously with one another by the same drive unit.

23 Claims, 7 Drawing Sheets

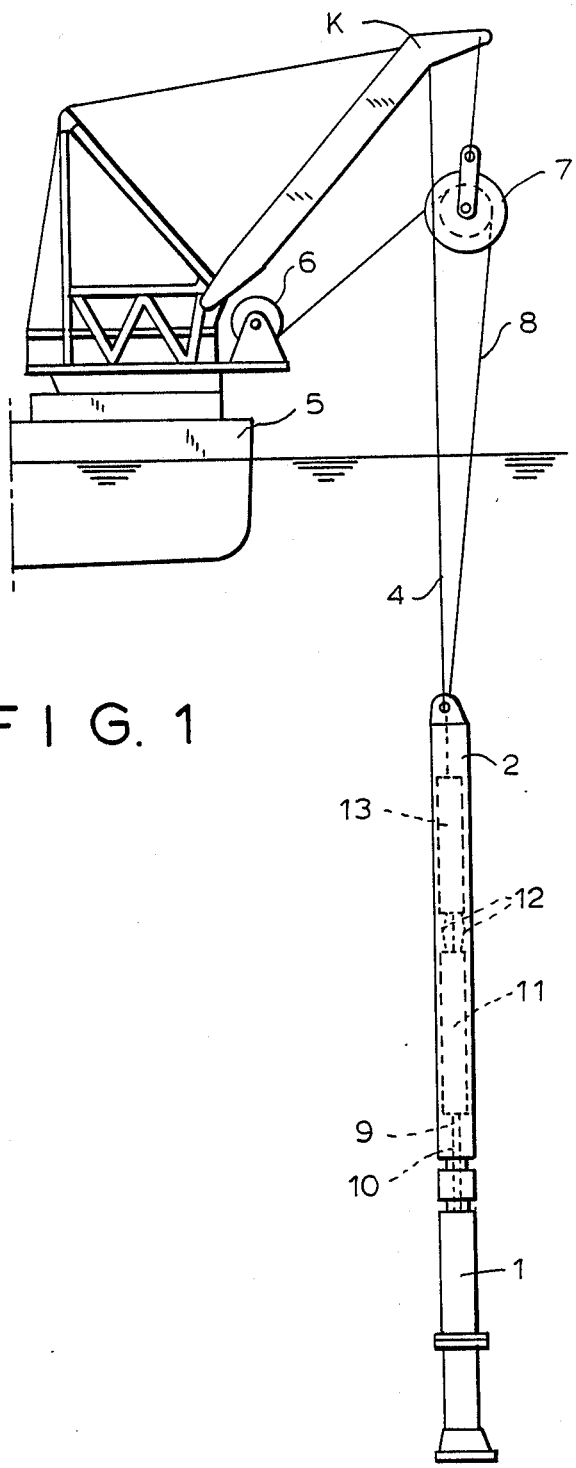
FIG. 1
FIG. 2
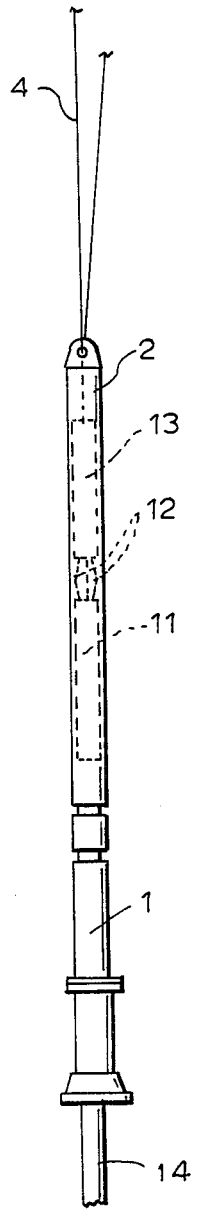

METHOD OF AND A DRIVE UNIT FOR DRIVING RAMMING PARTS UNDER WATER

BACKGROUND OF THE INVENTION

The present invention relates to a method of driving ramming parts under water in accordance with which a ramming device suspended on a supporting element and a submergible electrohydraulic drive unit are lowered under water, and the ramming device driven by the drive unit drives-in a ramming part. The invention deals also with a drive unit used for this method.

Excavation of raw deposits located on or under the sea bottom is performed with operations and by means of underwater arrangements and constructions which are arranged always in deep water. Therefore frequently ramming devices must be used in great water depths for driving-in of several ramming piles arranged at certain distances from one another. It is therefore always difficult to bring the ramming device on the ramming parts to be driven in with bearable time and labor expenses and to provide time and labor economical driving-in without damaging the ramming parts. Since for anchoring of offshore drilling platforms and similar structures many ramming piles of great diameter provided on their supporting legs must be rammed-in by respective heavy ramming devices with very high impact energy very deep into the sea bottom whose hardness increases with increasing depth, the ramming piles to be used often have to be dimensioned thicker and heavier than actually needed for the anchoring of the structure. This is needed for preventing bending damages to the ramming piles which have great length and are susceptible to bending forces, especially during the first phase of ramming-in, which can take place under high weight of several hundred tons of heavy ramming device, and also for preventing their deviation from the predetermined driving-in direction. Steel pipe piles which in practice often have several hundred meters and are provided with thick walls, are not only very expensive, but also heavy and dangerous to handle. The working ships therefore must be provided with high and thick derrick cranes.

For avoiding these difficulties, there have been utilized for ramming-in at relatively small water depths, relatively short ramming piles, which are then extended by additional pile portions which are welded to the driven-in piles above water. This, however, is not possible when ramming in great water depths.

For the utilization of narrower and thin-walled and therefore lighter ramming piles for ramming in great water depths, the ramming pile which extends freely from the sea bottom over a great length can only be pre-rammed with a light ramming device of a relatively low impact energy until no difficulties with their bending can be expected. Then the light ramming device must be withdrawn and a heavier ramming device is lowered onto the ramming pile to ram the same to the predetermined insertion depth. In this operation, however, two different ramming devices must be placed on the same ramming pile one after the other and withdrawn above water. In unfavorable weather conditions during offshore works, this takes too much time and requires high expenses because of enormous costs of modern work ship. This is especially true when the ramming must be performed in such water depths in which driving of the ramming device by pressure fluid which is supplied from a base above water is no longer possible because of the high pressure losses of long hose conduits and/or too high viscosity increase of the pressure fluid in cold sea water. In these cases each ramming device must be lowered with a correspondingly designed submergible electrohydraulic drive unit to the working depth, so that not only two different ramming devices, but also additionally two respective driving units must be made available and handled.

SUMMARY OF THE INVENTION

Accordingly, it is an object of the present invention to provide a method of driving ramming parts under water of the above mentioned general type, as well as suitable drive unit for this method, which make possible efficient driving of ramming parts in a simple, time- and labor-saving manner.

In keeping with these objects and with others which will become apparent hereinafter, one feature of the present invention resides, briefly stated, in a method in accordance with which a first ramming device suspended on a first supporting element is lowered under water with a submergible electrohydraulic drive unit a second ramming device is lowered on a further supporting element so that at least one ramming device assumes a seating position on one ramming part, then the drive unit is arranged laterally near or under one ramming device and connected with both ramming devices by hose conduits, after driving of one ramming part over a predetermined path by the ramming device seated on it this ramming device is transferred to another ramming part, while the other ramming device further drives-in the first ramming part or a further ramming part, and both ramming devices are driven successively after one another or simultaneously with one another by the same drive unit.

When the method is performed in accordance with the present invention, the thin-walled and light ramming piles which correspond to the respective requirements can be driven by two differently heavy ramming devices without damage to them, in substantially faster and more rational manner. The advantages are especially pronounced when a plurality of adjacent ramming piles must be driven-in. Since both ramming devices are driven from the same drive unit in correspondence with their energy consumption, only one driving unit is needed for flexible performance of the ramming works.

In accordance with another feature of the present invention a submergible electrohydraulic drive unit is provided and has a housing with a receiving space for receiving at least a portion of a ramming device and having upper and lower supporting plates and outer and inner walls, a plurality of pump units which include a hydraulic pump and associated electric motor and arranged between the inner wall and the outer wall at circumferential distances from one another, and switch means for distributing supply of pressure medium from the hydraulic pumps to the first and/or second ramming device.

This drive unit is described in further detail in the parallel U.S. patent application, Ser. No. 133,903.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a view schematically showing lowering of a conventional underwater ramming device provided with a submergible drive unit;

FIG. 2 is a view showing the ramming device of FIG. 1 in a position in which it is placed on a ramming pile;

DESCRIPTION OF THE PREFERRED EMBODIMENTS

Figure 3:
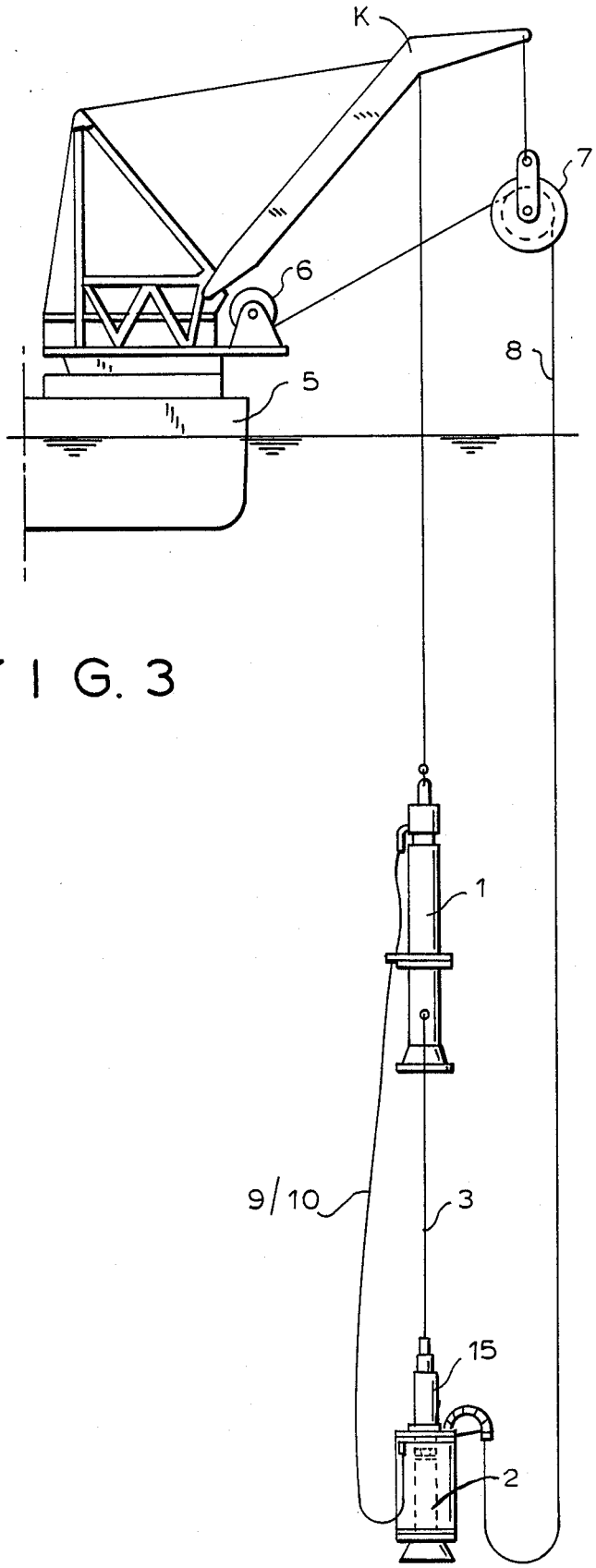
FIG. 3 is a view showing lowering of a ramming device in accordance with the present invention with a lighter ramming device suspended on the first ramming device and connected with a submergible drive unit.

The conventional working operation for driving of freely standing ramming piles under water is shown in FIGS. 1 and 3. The works are performed with a ramming hammer 1 which is suspended on a crane cable 4 extending from a crane K of a working ship 5. The ramming hammer 1 is connected with a drive unit 2 arranged on its upper side. The drive unit 2 has a pressure medium container 13, several pump units connected with the pressure medium container 13 by hose conduit 12, and electric motors which drive the pump units. The drive unit 2 is connected with the ramming hammer 1 with interposition of impact damping devices.

The pump units 11 are connected with a not shown hydraulic cylinder-piston unit of the ramming hammer 1 by hose conduits 9 and 10, The drive unit is supplied with electrical energy through an umbilical cable 8 which is guided over a winch 6 of the working ship 5 and over a deviating roller 7. The umbilical cable 8 contains a sufficient number of electrical conduits, and also control conduits, air conduits etc. which are required in a known manner for actuation and control of ramming hammer 1 and the drive unit 2. Since the parts of the drive unit are arranged in the longitudinal direction over one another, the ramming hammer 1 which practically has at least 20 meter length and the housing of the drive unit which has approximately 30 meter length results in a considerable length of the whole arrangement. Therefore the arrangement is difficult to handle especially during removing from and placing on the deck of a working ship 5. In addition, the longitudinally extending arrangement during lowering under water is difficult to position over the head of the ramming 1 pile to achieve an unobjectionable lowering the ramming hammer onto the ramming pile 14.

Figure 4:
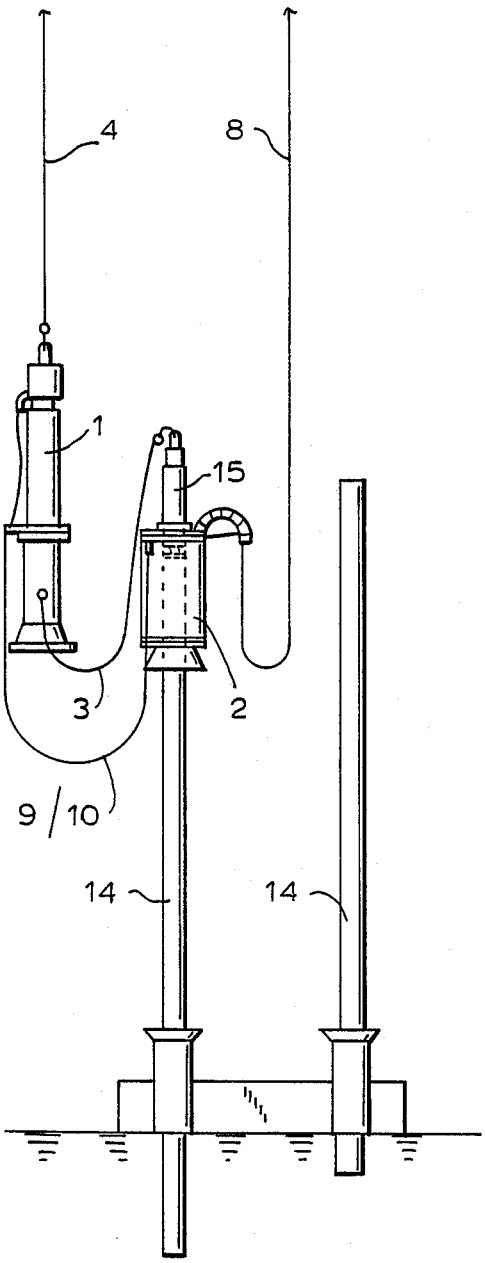
FIG. 4 is a view showing ramming devices of FIG. 3 with the lighter ramming device placed on a ramming pile.
Figure 5:
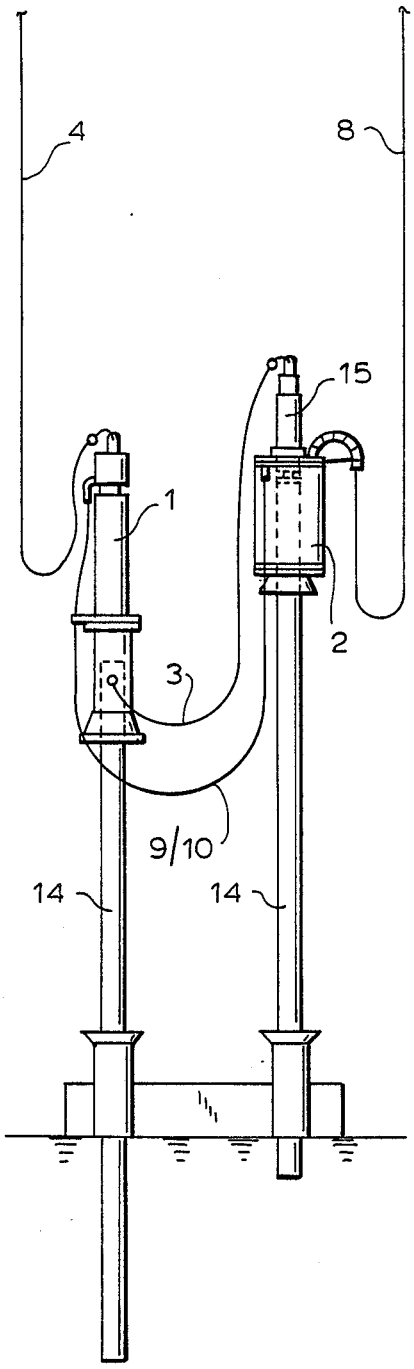
FIG. 5 is a view showing ramming devices of FIGS. 3 and 4 in a position placed on neighboring ramming piles.

FIGS. 3–5 show the working operation in accordance with the present invention. Here a heavy ramming device 1 is suspended on a supporting cable 4 of the crane K of the working ship 5 and lowered with a lighter ramming device 15 which is suspended on it via a further supporting element 3. The ramming device 15 is enclosed in a drive unit 2 which is connected with it and supplied via an umbilical cable 8 with energy. On the other hand, the drive unit 2 is not only connected with an associated driving device 15 but also is connected with the heavier ramming device 1 through hose conduits 9 and 10 and not shown signal conduits. Since the pump units of the drive unit 2 are driveable individually or in groups, and the pressure medium stream supplied from them can be supplied via a switching device with adjustable partial volumes to both ramming device 1 and 15, the ramming devices can be driven independently from one another.

In the position shown in FIG. 4, the lighter ramming device 15 which is connected with the drive unit 2 is placed on a ramming pile 14 which is installed on the sea bottom ready to be driven into it, but stands still, free with the greater part of its length above the sea bottom. The lighter ramming device 15 is driven by the drive unit 2 so as first to drive the ramming pile 14 with relatively low weight load and limited impact energy so that after this the heavier ramming device 1 can be placed onto the ramming pile 14 without endangering it. This position is shown in FIG. 5, in which the lighter ramming device 15 is removed from the pre-driven ramming pile 14 and placed onto a neighboring ramming pile 14, while the heavier ramming device 1 is brought onto the pre-driven ramming pile.

In the respective sequence then simultaneously the lighter ramming device 15 is driven for driving its ramming pile, while simultaneously the heavier ramming device 1 which is driven by the drive unit 2 via the hose conduits 9 and 10 rams-in the already pre-rammed ramming pile 14 to the predetermined insertion depth.

Figure 6:
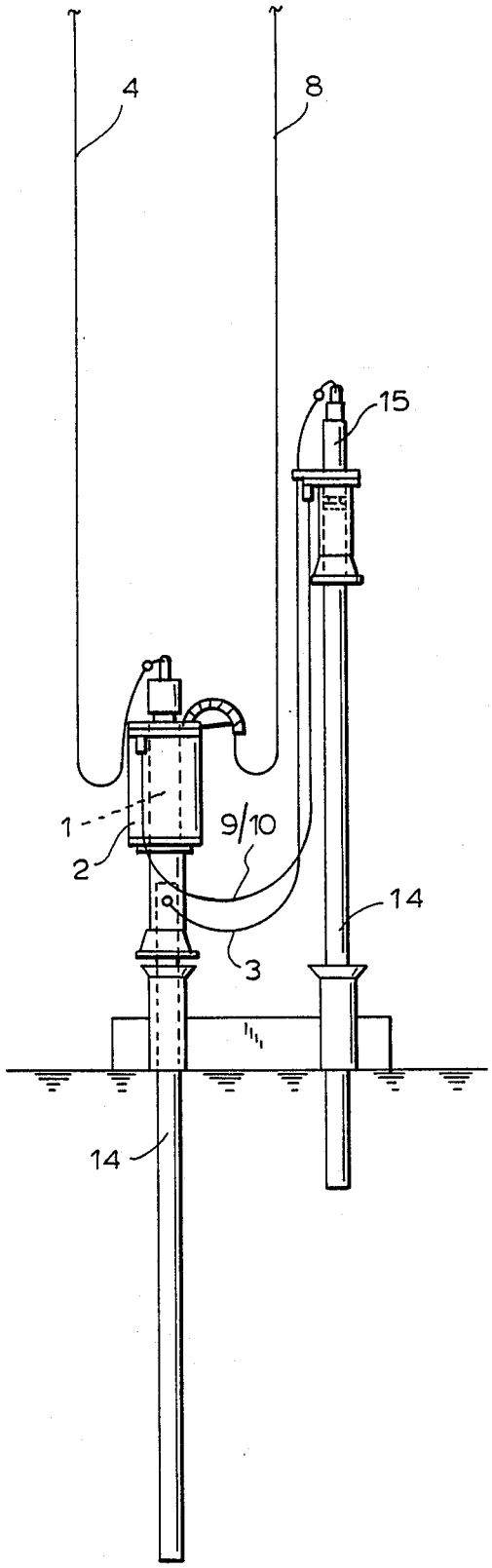
FIG. 6 is a view showing the ramming devices of FIGS. 3–5 with another arrangement of the drive unit in a position placed on further driven-in ramming pile.

FIG. 6 shows an advanced phase of a similar operation in which, however, the drive unit 2 is connected with the heavier device 1. This arrangement has the advantage that the smaller ramming device 15 which is now released from the drive unit 2 provides during its placing on the ramming pile 14 substantially smaller weight load and therefore can pre-ram the ramming pile 14 in an especially fine manner.

When the ramming devices 1 and 15 are placed as shown in FIGS. 5 and 6 near one another on neighboring ramming piles 14, naturally first the ready pre-rammed ramming pile 14 can be driven with the heavier ramming device 1 with the full energy of the drive unit 2 to the predetermined insertion depth, where after the next ramming pile 14 with the smaller ramming device 15 is pre-rammed. This requires however longer hose conduits between the drive unit 2 and the ramming devices 1 or 15 separated from it, since they are farther spaced from one another than in the event of the operation with reversed ramming sequence. The longer hose conduits lead also to a somewhat more difficult handling and resulting additional costs.

In the shown way, several ramming piles can be driven-in one after the other in time saving and rational manner with two ramming devices 1 and 15 of different weight and different impact energy with the same drive unit 2 by only one-time lowering of the devices. Since the previously required withdrawal of the devices during intermediate time above water and thereby connected handling risks are dispensed with, considerable time, labor and cost economy is achieved.

Figure 9:
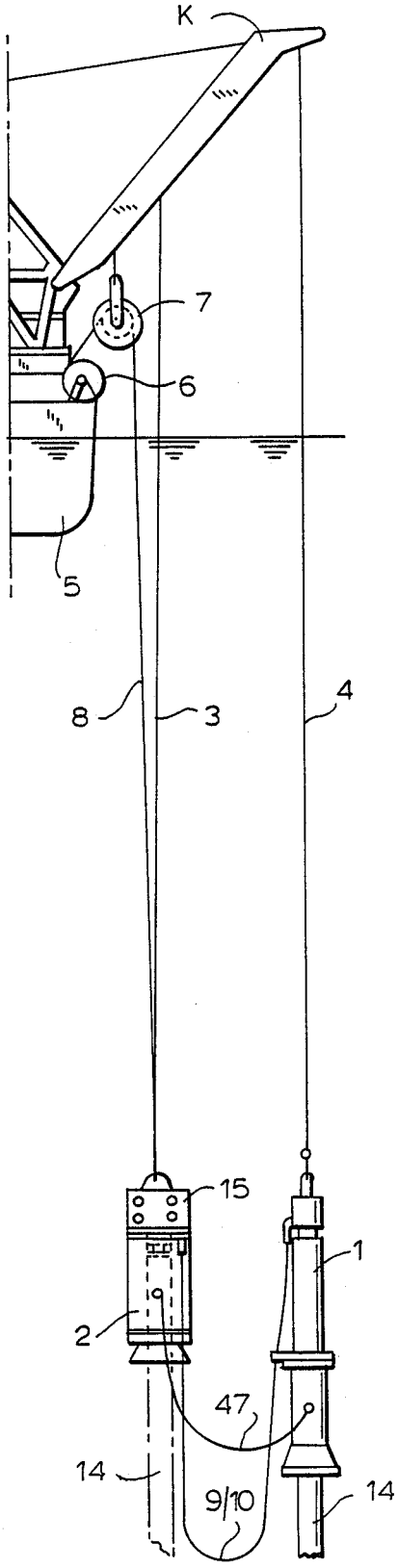
FIG. 9 is a view showing the ramming devices of FIGS. 7 and 8 with the respective ramming device seated on a ramming pile.
Figure 7:
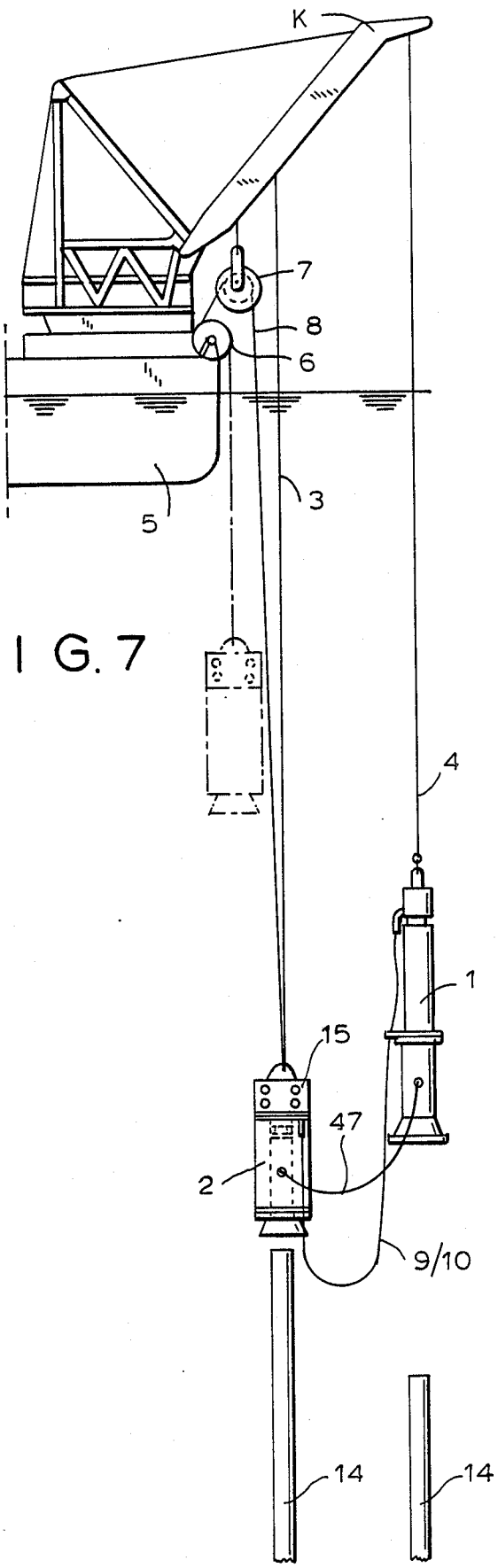
FIG. 7 is a view showing the lowering of two ramming devices on separate supporting elements.
Figure 8:
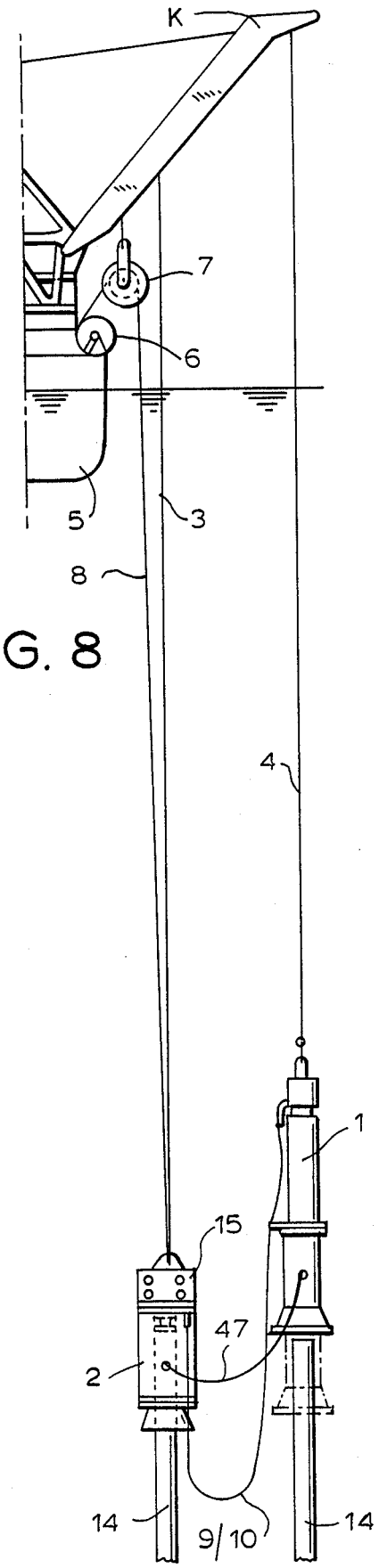
FIG. 8 is a view showing the ramming devices of FIG. 7 with a vibration ramming device seated on a ramming pile.

When several somewhat farther spaced ramming piles must be driven-in, the ramming devices 1 and 15 shown in FIGS. 7–9 can be advantageously lowered respectively on separate supporting cables 4 and 3 so that the drive unit 2 arranged on one ramming device 15 is connected both with this ramming device and also via the hose conduits 9 and 10 and signal conduits as well as a shorter distance limiting cable 47 with the respective other ramming device 1. In the shown embodiment the lighter ramming device 15 is formed as a vibration ramming device with flyweight motors which are driven from the hydraulic pump of the drive unit 2 via hydraulic motors. In accordance with a somewhat different operation shown in a broken line in FIG. 7, one of the ramming devices, for example the lighter vibration ramming device 15, can be suspended directly on the umbilical cable 8 which is required for supplying the drive unit 2. The umbilical cable 8 extends from a winch 6 on the working ship and suspended over a deviating roller 7 on the crane K. This is possible since the umbilical cable 8 designed for the rough handling in offshore works normally is especially robust and withstands a relatively high pulling loading. This arrangement also makes possible to maintain the very expensive umbilical cable 8 shorter, since it does not first extend from the winch 6 to the deviating rollers 7 on the upper end of the crane beam which in work cranes with beam length of over 100 meters is a considerable problem.

With this working operation it is possible to freely select whether the lighter ramming device 15 first prerams one or several ramming piles 14 and/or the heavier ramming device 1 simultaneously drives another optionally move loadable ramming pile 14 and then must be transferred to already pre-rammed ramming pile 14, or both ramming devices 1 and 15 must drive in respectively the adjacently arranged ramming piles 14. For such cases it makes sense to drive two ramming devices of the same impact power or the same weight near one another by the same drive unit 2. With the utilization of a respective number of underwater cameras, the progress of the individual ramming processes can be observed near one another and if needed the volume distribution of the pressure medium being supplied from the drive unit to the individual ramming devices 1 and 15 into partial streams can be respectively adjusted.

In the arrangement shown in FIG. 8, the left ramming pile 14 was already pre-rammed with the lighter ramming device 15 for a sufficient path, while the heavier ramming device 1 is either held above the right ramming pile 14 or lowered onto it as shown in a broken line. It can either be inactively retained there or with sufficient drive capacity of the drive unit and the required subdivided feeding quantity, can work simultaneously with the lighter ramming device 15.

In the position shown in FIG. 9 the heavier ramming device 1 already drove-in the right ramming pile 14, while the lighter ramming device 15 is either inactive on the left pile 14 or drives it further in.

Figure 10:
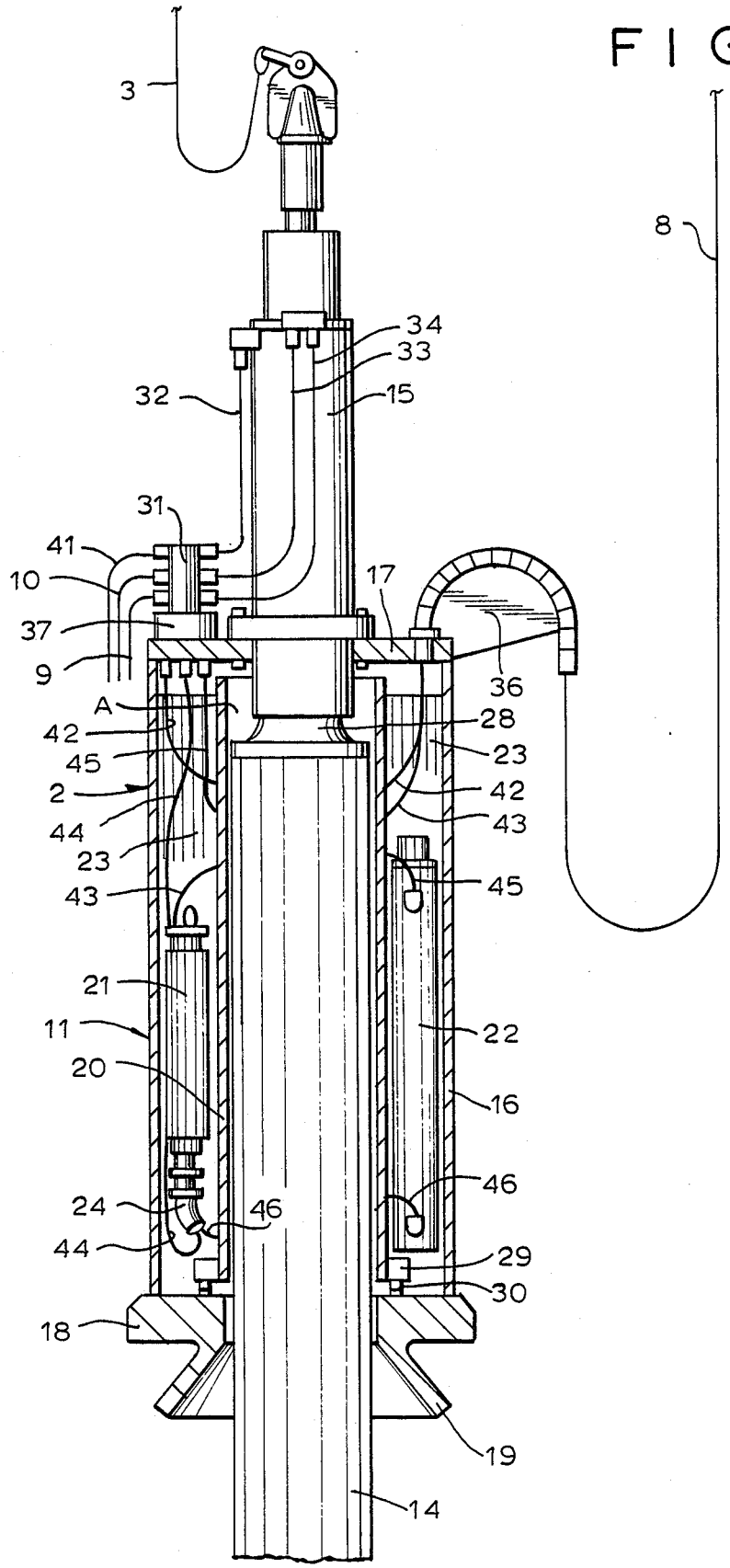
FIG. 10 is a view showing a schematic longitudinal section through a ramming device seated on a ramming pile and provided with a built-on drive unit.

In FIG. 10 the lighter ramming device 15 which is formed as a ramming hammer is placed with the built-on drive unit 2 onto a ramming pile 14 provided with an impact plate 28. The drive unit 2 has a housing with a throughgoing central receiving space A, a ring-shaped upper supporting plate 17, a ring-shaped lower supporting plate 18 provided with an inlet cone 19, an outer wall 16 connected with the supporting plates, and a cylindrical inner wall 20 surrounding the receiving space. A plurality of pump units 11 which are distributed in a circumferential direction are arranged in a ring-shaped chamber which is formed between the cylindrical outer wall 16 and the inner wall 20. Each pump unit 11 includes an electric motor 21 and a hydraulic pump 22 connected with the latter. They are arranged parallel to the longitudinal axis of the receiving space A. Each pump unit is associated with substantially cylindrical pressure medium container 22 which is connected with the hydraulic pump 24 through a hose conduit 46. The electric motors 21 ar connected with the respective electrical conduits in the umbilical cable 8 via separate electrical conduits 43 and a water-tight connector box arranged on the upper supporting plate 17. The pump units 11 are arranged via respective not shown elastic supporting elements on the inner wall 20, which in turn is elastically biased against the lower supporting plate 18 and the upper supporting plate 17 by several pre-tensioned spring cylinder-piston units 29 provided with pistons 13 and distributed over the circumference. Advantageously, the pump units 11 can be springly supported radially inwardly against the ramming pile 14 or the hammer housing of the ramming device 15.

The pressure medium supplied by the hydraulic pumps 24 flows via a hose conduit 44 to a switching device 37 which is arranged on the upper supporting plate 17 and connected with the umbilical cable 8 via a signal conduit 42. The pressure medium flows via a downstream multiple connector 31 and a hose conduit 33 to the hydraulic cylinder of the ramming device 15, and optionally also via a hose conduit 9 to the ramming device 1. The pressure medium which flows back runs over a hose conduit 34 or 10, the multiple connector 31 and the return conduit 45 to the pressure medium container 22. Further details of the arrangement, construction and biasing of the electric motors 21, the hydraulic pumps 24 and the pressure medium container 22, as well as the conduits which connect them with one another and with the ramming device 15 are disclosed in the parallel U.S. application Ser. No. 133,903.

Figure 11:
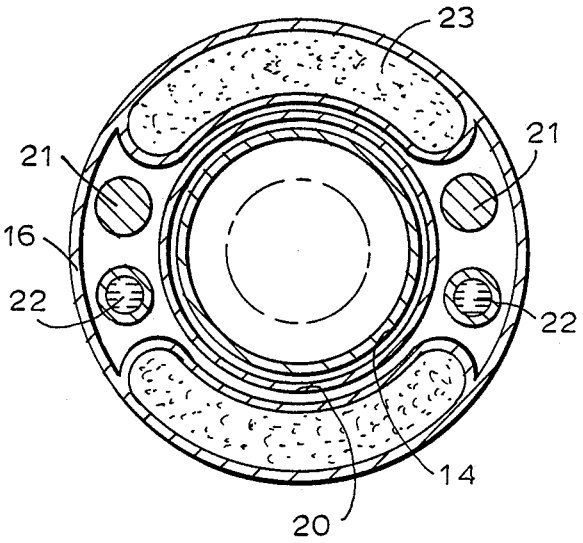
FIG. 11 is a view schematically showing a cross-section of the drive unit of FIG. 10 in substantially half height.

For avoiding great loading, acting upon the not pre-rammed ramming pile 14 during placing of the ramming device 15, at least one buoyancy container 23 is arranged in the ring-shaped chamber between the outer wall 16 and the inner wall 20. It either has a wall which resists the predetermined submersion depth, or can be filled with gas via a supply conduit integrated in the umbilical cable 8 with expulsion of water. As can be seen from FIG. 11, in this embodiment two buoyancy containers 23 extend substantially over the whole height of the outer wall. Each buoyancy container 23 advantageously has a blockable lower opening for flowing-in and flowing-out of water, and also a blockable upper inlet opening for gas. Thereby by respective control both the degree of gas filling in the buoyancy container 23 and the gas pressure are adjustable.

Figure 12:
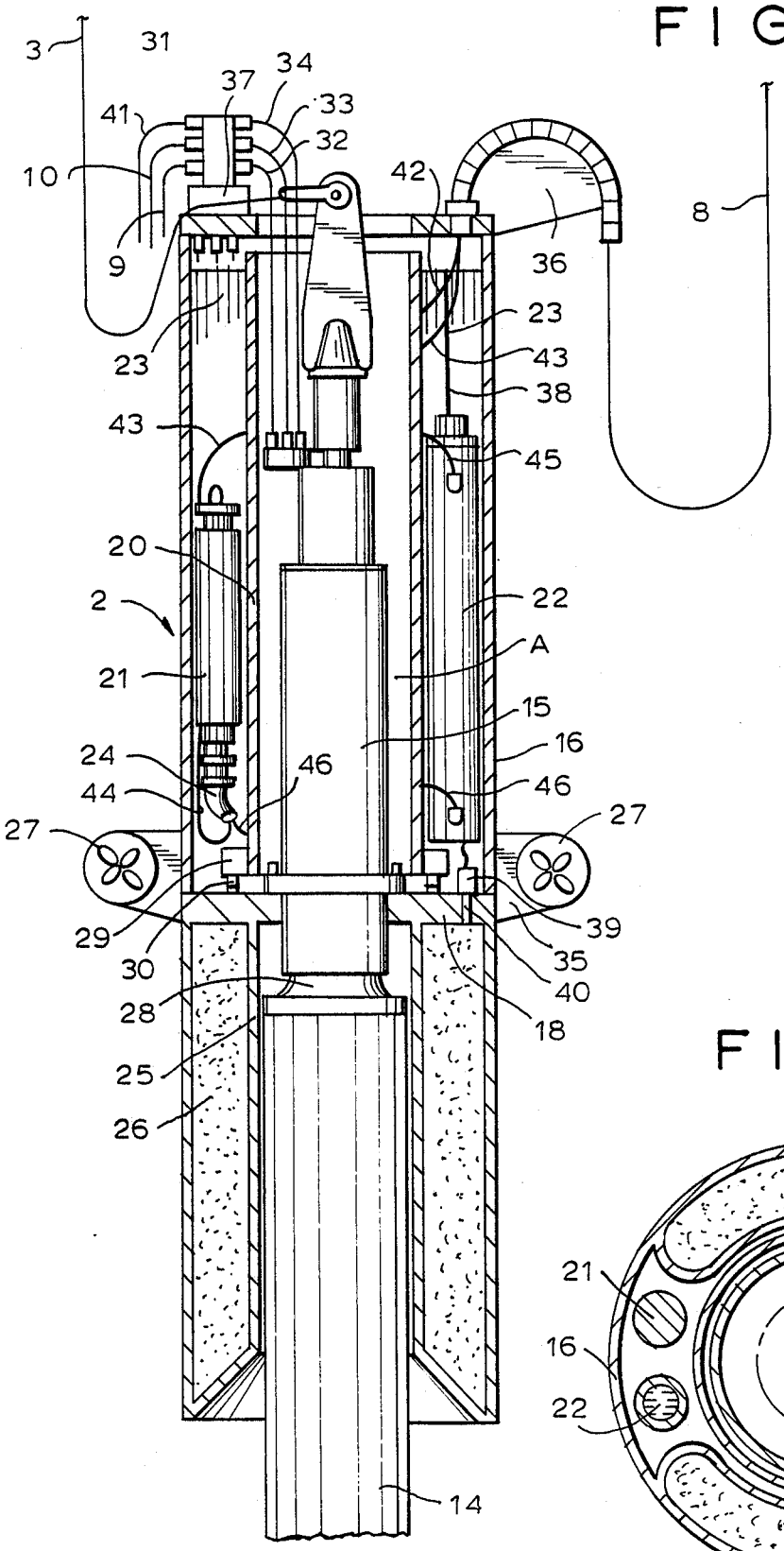
FIG. 12 is a view schematically showing a longitudinal section through a ramming device seated on a ramming pile in accordance with a different embodiment of the drive unit.

In a different embodiment shown in FIG. 12 the ramming device 15 is releasably connected with the lower supporting plate 18 of the drive unit 2 via a mounting flange which is arranged in the lower portion of the hammer housing. The lower supporting plate 18 carries in this case additionally a cylindrical downwardly extending pile guide 25 with an inner chamber formed also as a buoyancy container 26. This buoyancy container can be filled with gas via a gas conduit 38, a valve 29 and a throughgoing opening 40. Upwardly projecting consoles 35 are arranged on the outer wall 16 and support a propeller device 27 which is driven by a not shown hydraulic motor and associated connecting conduits from the hydraulic pumps 24. By means of this positioning device, the ramming device 15 which is suspended on the supporting cable 3 can be displaced substantially horizontally and/or turned about its central axis for placing on the ramming pile 14. It is to be understood that the ramming devices 1 and 15 can be provided with such positioning devices.

The above shown preferable embodiments of the inventive method and the respective drive units can of course be modified by an expert in depending on the requirements of each individual application in different ways, as long as the essential feature of the lowering of two ramming devices with a joint drive unit is maintained.

It will be understood that each of the elements described above, or two or more together, may also find a useful application in other types of constructions differing from the types described above.

While the invention has been illustrated and described as embodied in a method of driving of ramming parts under water, and a submergible electrohydraulic drive unit for underwater ramming devices, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A method of driving ramming parts under water, comprising the steps of lowering a first ramming device suspended on a first supporting element and also a submergible electrohydraulic drive unit under water; lowering in addition to said first ramming device also a second ramming device suspended on a second supporting element so that at least one of said ramming devices assumes a seating position on a ramming part; arranging the drive unit close to one of the ramming devices and connecting it with both ramming devices; partially driving one ramming part by said one ramming device and then transferring said one ramming device to another ramming part; further driving the one ramming part or a further ramming part in by the other ramming device; and driving both ramming devices by the same drive unit.

2. A method as defined in claim 1, wherein said driving the ramming devices includes driving the ramming devices by the drive unit successively after one another.

3. A method as defined in claim 1, wherein said driving the ramming devices includes driving the ramming devices by the drive unit simultaneously with one another.

4. A method as defined in claim 1, wherein said arranging includes arranging the drive unit laterally near said first ramming device.

5. A method as defined in claim 1, wherein said arranging includes arranging the drive unit at a lower side of said first ramming device.

6. A method as defined in claim 1, wherein said lowering includes lowering said first ramming device which is heavier and said second ramming device which is lighter and has a lower driving action.

7. A method as defined in claim 6, wherein said lowering includes suspending the second ramming device on the first ramming device by at least one flexible supporting element.

8. A method as defined in claim 6, wherein said arranging includes arranging the drive unit laterally near said second lighter ramming device.

9. A method as defined in claim 8, wherein said arranging includes arranging the drive unit under the lighter ramming device.

10. A method as defined in claim 6, wherein said arranging includes arranging the drive unit laterally near said first heavier ramming device.

11. A method as defined in claim 6, wherein said arranging includes arranging the drive unit under said first heavier ramming device.

12. A method as defined in claim 1, wherein said lowering includes providing an umbilical cable for the drive unit and suspending at least one of the ramming devices on the umbilical cable.

13. A method as defined in claim 1 for driving a plurality of ramming parts, said placing and driving including driving the first ramming part with the second ramming device which is lighter until the first ramming part can without danger take up a driving force of the first ramming device which is heavier, then transferring the second lighter ramming device to a further ramming part and driving the first ramming part by the first heavier ramming device to a predetermined insertion depth, and then transferring the ramming devices one after the other in a stepped manner to further ramming parts, so that each ramming part is first driven-in by the second lighter ramming device over a sufficient path and then further driven by the heavier first ramming device.

14. A method as defined in claim 1, wherein said lowering includes lowering the ramming devices at least one of which is formed as a vibration ramming device.

15. A method as defined in claim 14, wherein said lowering includes using the vibration ramming device as a lighter ramming device and the other of the ramming devices as a heavier ramming device with a hydraulically driven impact body.

16. A method as defined in claim 1, wherein said lowering means includes using the drive unit which has a central receiving shaft for receiving at least a part of a respective one of the ramming devices and also a surrounding housing.

17. A method as defined in claim 1, wherein the drive unit forms one element and at least one of the ramming devices forms another element, said lowering includes at least partially filling with gas a buoyancy chamber provided in one of said elements.

18. A method as defined in claim 17, wherein said drive unit forms one element and at least one of the ramming devices forms another element, said lowering includes at least partially filling with gas a buoyancy chamber provided in both said elements.

19. A method as defined in claim 17, wherein said filling inludes selecting a quantity of the gas for producing a buoyancy so that a weight loading produced by a respective one of the ramming devices placed first on the ramming part as well as of the drive unit does not exceed a predetermined limiting value.

20. A method as defined in claim 17, wherein said filling includes selecting a gas pressure in the floating chamber so as to adjust it to the outer pressure at a predetermined working depth to prevent a pressure action on walls of said one element.

21. A method as defined in claim 1; further comprising the step of producing a horizontally directed thrust stream for positioning a respective one of the ramming devices during placing on the ramming part.

22. A method as defined in claim 1; further comprising the step of producing a horizontally directed thrust stream for positioning the drive unit associated with the respective one of the ramming devices during placing on the ramming part.

23. A method as defined in claim 1, wherein said lowering includes lowering together with the ramming devices at least one ramming part connected with one of the ramming devices.

* * * * *